United States Patent [19]

Alberti et al.

[11] Patent Number: 4,624,202

[45] Date of Patent: Nov. 25, 1986

[54] SEWING MACHINE DIFFERENTIAL FEED

[75] Inventors: Adriano Alberti; Mario Valle, both of Pavia, Italy

[73] Assignee: Rockwell-Rimoldi S.p.A., Italy

[21] Appl. No.: 808,190

[22] Filed: Dec. 12, 1985

[30] Foreign Application Priority Data

Apr. 30, 1985 [IT] Italy ..... 21676/85[U]

[51] Int. Cl.[4] ..... D05B 27/24

[52] U.S. Cl. ..... 112/313; 112/323

[58] Field of Search ..... 112/313, 323, 324

[56] References Cited

U.S. PATENT DOCUMENTS 4,067,274 1/1978 Marforio ..... 112/313

4,469,039 9/1984 Marchesi ..... 112/313 X 4,527,497 7/1985 Kerr et al. ..... 112/313

*Primary Examiner*—Werner H. Schroeder

*Assistant Examiner*—Andrew M. Falik

[57] ABSTRACT

A sewing machine which has two substantially independent sets of feed dog teeth comprising a set of main fabric feed dog teeth and secondary or differential feed dog teeth and includes a drive therefore defined by a main drive shaft and a two piece interconnected secondary shaft. Feed dog teeth supporting brackets are mounted between the shafts. A stirrup interconnects the support brackets so that both sets of dog teeth are moved cyclically and in a synchronized manner with one another.

8 Claims, 9 Drawing Figures

FIG. 1
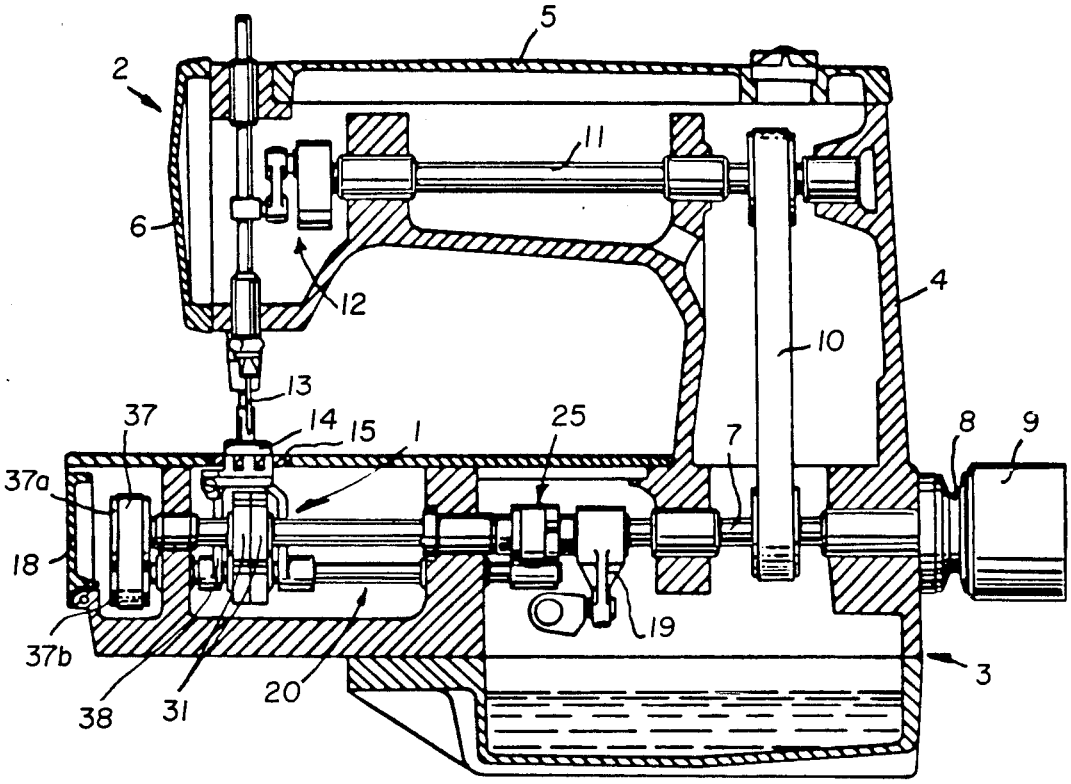
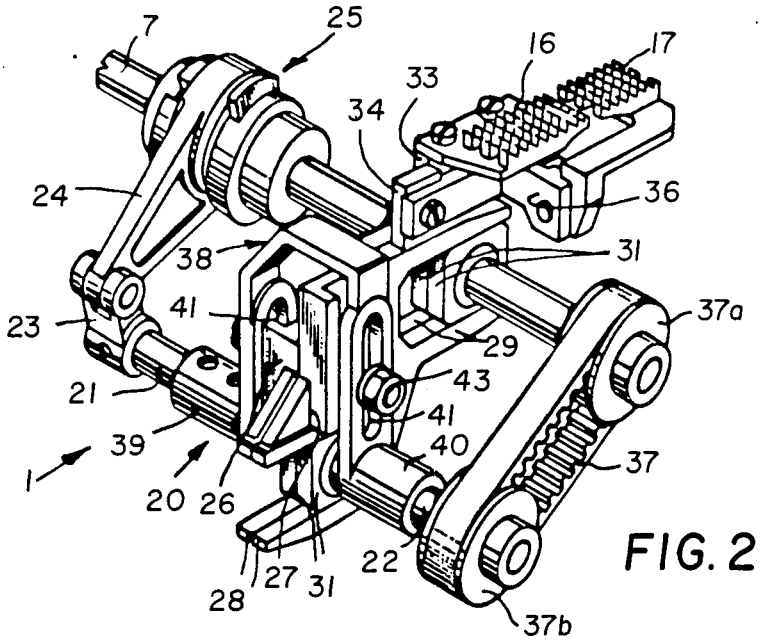
FIG. 2

SEWING MACHINE DIFFERENTIAL FEED

BACKGROUND OF THE INVENTION

The present invention relates to a device for feeding the fabric being sewn by sewing machines.

As is known, in sewing machines, the fabrics being sewn are fed by feed dog teeth which are arranged in the region of the needle plate and are movable so as to feed new fabric continuously between the needle plate and the pressure shoe or pressure foot.

These teeth are operated by special mechanisms which form the devices for feeding the fabrics being sewn.

These devices are of fundamental importance in sewing machines, since proper functioning of the sewing machines and the possibility of making stitches of varying length, which are more or less taut, depend on the correct operation of the said devices and on the possibility of varying the feed rate of the fabric, as required.

Numerous feed devices have already been devised and produced: reference is made to the feed devices already produced by the same Applicant and the feed device described in Italian Pat. No. 856,128.

Of these devices, the most efficient and important ones for industrial sewing machines are those which involve the use of two sets of feed teeth: a set of main teeth and a set of differential feed dog teeth arranged in succession and movable cyclically in a synchronized manner.

The main feed dog teeth, which are also called stitch feed dog teeth, determine substantially the amount of fabric which must pass beneath the pressure shoe.

The differential or secondary feed dog teeth, on the other hand, wrinkle or pucker the fabric when they move by amounts greater than those of the main teeth, or may tension the fabric when, on the contrary, they move by smaller amounts.

Puckering is generally performed for esthetic reasons, whereas tensioning may be necessary when an elastic fabric is being sewn and it is required that the stitches should not restrict the elasticity of the fabric itself. In this case, tensioning the fabric during sewing has the effect that, once the fabric has been released, the sewing thread is of sufficient length and the stitches are not taut.

So that the differential feed dog teeth are able to move by amounts different from those of the main feed dog teeth, while remaining in synchronism with the latter, existing feed devices comprise considerably complex kinematic mechanisms which extend from at least three drive shafts, with all of the movements produced by a main rotating shaft. The feed dog oscillations of the teeth in the vertical direction are obtained by means of cams mounted on rotating shafts, whereas the oscillations in the horizontal direction are obtained by means of connecting rod/crank arrangements. The various devices contain a large number of components in order that all the oscillations may be performed, without each of these oscillations generating obstruction to the others. Moreover, it appears to be complicated and in many cases very difficult to adjust the movements of the differential feed dog teeth so as to obtain movements of the same which are greater or less than those of the main feed dog teeth. This operative characteristic of known feeling devices appears restrictive of the use thereof.

SUMMARY OF THE INVENTION

The general object of the present invention is, therefore, to overcome the abovementioned drawbacks, by designing a feed device which has a simple structure, consists of few component parts and can be easily adjusted even by unskilled persons. Within the context of this general object, it is an important object of the present invention to design a feed device which is able to operate with a great deal of precision so as to allow even major adjustments of the movements of the differential feed dog teeth with respect to the main feed dog teeth.

Another important object of the present invention is to design a feed device which has small dimensions such that it can be easily and economically inserted into sewing machines.

These objects and other objects which will emerge more clearly below are substantially achieved by a device for feeding the fabric being sewn by sewing machines, of the type comprising a set of main feed dog teeth and a set of differential feed dog teeth arranged in succession and operated by two support elements both supported oscillatably in the vertical direction by eccentrics mounted on a rotatable main shaft and on a secondary shaft located alongside the said main shaft. A stirrup mounted by means of a first and a second sleeve on the said secondary shaft is divided into a first and a second half-shaft. The first half-shaft is oscillatable cyclically and is integral with the said first sleeve, so as to cause the said stirrup to oscillate cyclically. The second half-shaft is rotatable together with the said main shaft and is integral with the said eccentrics and the said second sleeve is rotatably supported by the said second half-shaft.

DESCRIPTION OF THE DRAWINGS

Further characteristic features and advantages will become more apparent from the description of a preferred, but not exclusive embodiment of the invention, illustrated by way of example in the attached drawings in which:

FIG. 1 shows an overall view, in cross-section, of a sewing machine in which the feed device according to the invention has been inserted;

FIG. 2 is a perspective view of the feed device according to the invention, in isolation;

Figure 4:
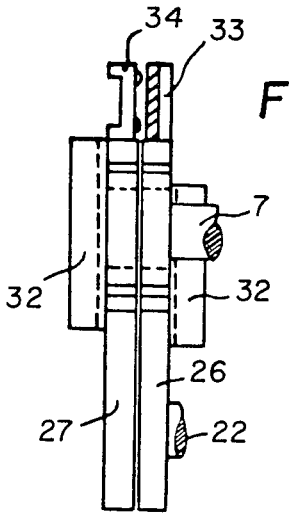
FIGS. 4 and 5 are a side view and front view of the support elements forming part of the device shown in FIGS. 2 and 3.
Figure 5:
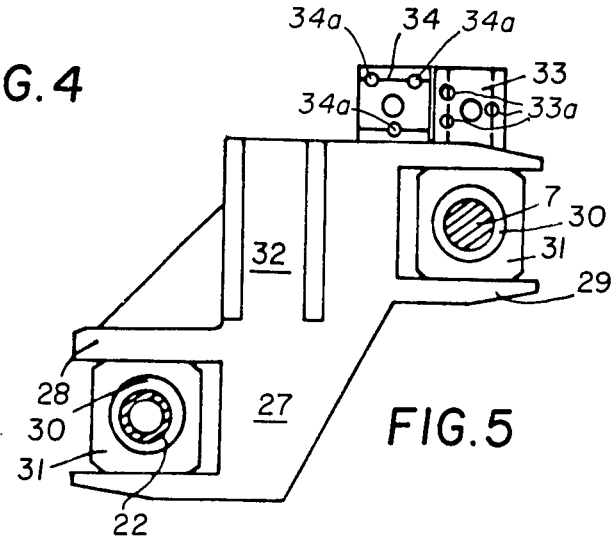
Figure 6A:
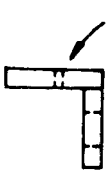
Figure 6B:
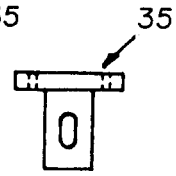
Figure 7A:
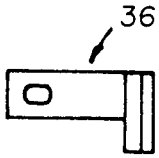
Figure 7B:
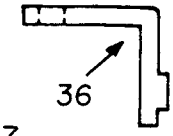

FIGS. *6a*, *6b* are two views, at right angles to each other, of a joining element which can be fixed to one of the support elements shown in FIGS. 4 and 5; and FIGS. *7a*, *7b* show, respectively, in elevation and in plan view, a second joining element shown in FIGS. 4 and 5 and which extends in the direction of an associated set of feed dog teeth.

DESCRIPTION OF THE PREFERRED EMBODIMENT

With reference to the figures mentioned, the feed device according to the present invention is indicated in its entirety by the reference number 1.

It is housed inside a sewing machine 2 which has, in a manner known per se, a base 3, an upright or column 4, an arm 5 and a head-piece 6.

The base 3 has passing through it a main shaft 7 which projects from the base itself in the form of a pulley 8 and a handwheel 9. In a known manner, the pulley 8 is connected to a drive belt operated by a motor.

The main shaft 7 drives, via a belt 10 and associated pulleys, an upper shaft 11 which, via suitable linkages 12 known per se, causes the movement of a needle 13.

The needle 13 is arranged adjacent to a pressure shoe 14 which is situated above a needle plate 15 through which the feed dog teeth for feeding the fabric to be sewn emerge. These teeth, which are shown in FIG. 2, consist of a set of main feed dog teeth 16 and a set of differential feed dog teeth 17 which are aligned with the main feed dog teeth 16 and arrranged behind the same, in the direction in which the fabric is fed.

The main shaft 7 controls all the movements of the feed dog teeth 16 and 17 and in fact extends along the entire length of the base 3 as far as a side cover 18 arranged opposite the handwheel 9.

The main shaft 7 also drives the other devices in the sewing machine 2, which are not shown since they do not form the subject of the present invention.

Reference is made, solely by way of example, to the looper actuating mechanism 19, shown in FIG. 1, which causes the looper of the machine 2 to move to and fro parallel to the main shaft 7 of the machine in order to pick up and release the thread loop for each stitch.

Figure 3:
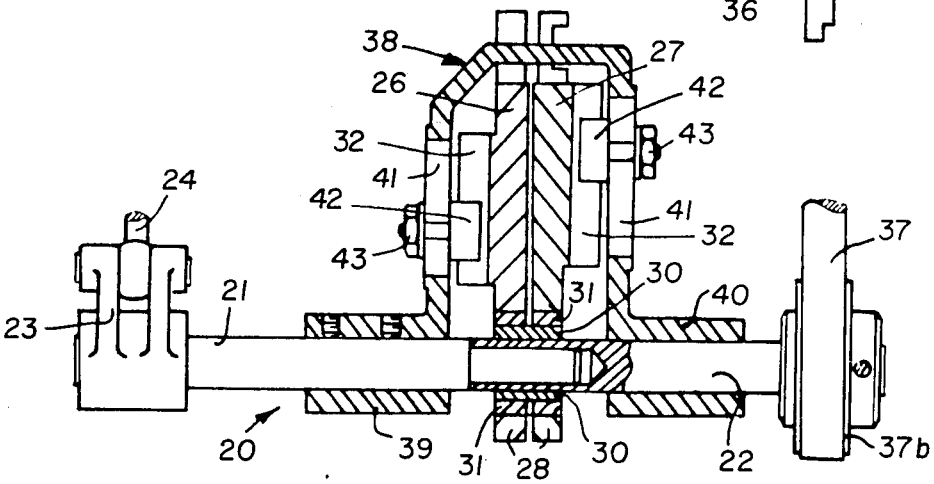
FIG. 3 shows, in elevation, and in partial cross-section, the same feed device shown in FIG. 2.

The feed device according to the invention is operated by two shafts: the main shaft 7 and a secondary shaft 20. The secondary shaft 20 is divided in the region of its median part into two half-shaft sections, as can be seen in FIG. 3: a first half-shaft 21 and a second half-shaft 22 which are aligned with each other and mutually engaged in telescopic fashion. The two half-shafts 21 and 22 are freely rotatable with respect to each other and are connected, at their furthest ends, to respective drive components.

The first half-shaft 21 is connected, via an oscillating arm 23 and a connecting rod 24, to a stitch-adjustment eccentric 25 mounted on the main shaft 7. The stitch-adjustment eccentric 25 has a structure which is known per se: attention is drawn, in this respect, to Italian Pat. No. 951,304 filed in the name of the same Applicant.

The free end of the second half-shaft 22, however, is connected, via a toothed belt 37 and associated pulleys 37*a* and 37*b*, to a free end of the drive shaft 7. More precisely, the abovementioned transmission arrangement is housed in the left-hand lateral part of the base 3 of the machine and is easily accessible for the purposes of maintenance.

In practice, the second half-shaft 22 of the secondary shaft 20 which is parallel and adjacent to the main shaft 7 is rotatable together with the main shaft 7, and the first half-shaft 21 of the secondary shaft 20 oscillates at a rate determined by the same main shaft 7.

Two support element are mounted on the secondary shaft 20, more specifically on the second half-shaft 22 and on the main shaft 7: a first support elements 26 connected via joining elements to the main teeth 16, and a second support element 27 connected via further joining elements to the differential teeth 17.

The support elements 26 and 27 are shown in isolation in FIGS. 4 and 5. They are substantially flat and have, at substantially opposite ends, a first fork 28 and a second fork 29. The forks 28 and 29 point in opposite directions to each other, and between the prongs of each of them there is a mechanism for lifting the support elements 26 and 27 and hence the teeth 16 and 17.

In particular, the said lifting mechanisms, which are identical to each other, comprise a lifting eccentric 30 and blocks 31 which are slidably inserted in the forks 28 and 29 and surround the lifting eccentric 30.

It is pointed out that the first fork 28 is arranged on the secondary shaft 20, whereas the second fork 29 is arranged on the main shaft 7, and that a single lifting eccentric 30 is provided on each said shaft, whereas each fork of each support element 26, 27, is engaged with its own block 31.

The figures show, moreover, that the support elements 26 and 27 have grooves 32 which are substantially vertical and first and second lugs 33 and 34 respectively, which protrude from the first support element 26 and the second support element 27 and which can be fixed to a first joining element 35 and a second joining element 36, respectively. Via further lugs, the joining elements 35 and 36 support the main teeth 16 and the differential teeth 17, respectively, as can also be seen in FIG 2.

It is also pointed out that the joining elements 35 and 36 are fixed to the ears 33 and 34 by means of screws which are inserted in holes provided in the said lugs and in eyelets provided in the said joining elements.

Moreover, further holes 33*a* and 34*a* are provided in the said lugs, which holes are arranged at the vertices of equilateral triangles and allow screws to be inserted which, depending on their degree of projection, determine the position of the joining elements 35 and 36 and consequently the position of the teeth 16 and 17. In practice, the said holes arranged at the vertices of equilateral triangles make it possible to arrange the teeth 16 and 17 in a precisely coplanar and aligned manner with respect to the needle plate 15.

A stirrup 38 is also mounted on the secondary shaft 20, which stirrup is shaped substantially in the form of an inverted U and is provided with two coaxial sleeves: more particularly a first sleeve 39 which is fixed by means of screws to the first half-shaft 21, and a second sleeve 40 rotatably supported on half-shaft 22, the stirrup defining a crank arm which moves each sliding element 42. The stirrup 38 is provided, on its two arms, with notches 41 in the form of elongated holes which, when the feed device 1 is mounted, are located along the sides of the grooves 32 of the support elements 26 and 27. As shown in FIG. 3, a sliding element 42 suitable to be locked on the stirrup 38 by means of screws 43 is mounted in notches 41.

In actual fact the sliding elements 42 are the only elements of direct contact between the stirrup 38 and the support elements 26 and 27 and they can be positioned in a free and independent manner with respect to one another. In the drawings grooves 32 and notches 41 are lightly offset in height, in the region of each arm of the stirrup 38, for the purpose of enabling particular positionings of the sliding elements 42. The operation of the feed device according to the invention is as follows.

When the main shaft 7 rotates, its rotation, through belt 37, is transmitted to the second half-shaft 22 on which lifting kinematic mechanisms are mounted which are quite similar to those mounted on the main shaft 7 itself.

These lifting kinematic mechanisms are synchronized and in timed relationship with respect to one another so that the support elements 26 and 27 are vertically raised at the same instant and by the same amount in the region of their respective forks 28 and 29. As a result, each feed dog 16, 17 is caused to project upwardly from the needle plate by the same amount and maintained perfectly parallel to the working surface of the sewing machine 2.

The movement in a horizontal direction of the feed dogs 16 and 17 is controlled by the stirrup 38 and depends on the positioning of the sliding elements 42.

In fact each sliding element 42 can be positioned at different distances from the secondary shaft 20, so that the stirrup 38, on carrying out an oscillatable movement controlled by the first half-shaft 21, by the action of the stitch-adjusdatment eccentric 25, connecting rod 24 and oscillating arm 23, imparts a cyclical rectilinear movement to each support element 26, 27, the amplitude of which, for each support element, depends on the position in which the respective sliding element 42 is. In other words, the amplitude of the cyclical rectilinear movement of the support elements 26 and 27 and therefore of the feed dogs 16 and 17 depends on the length of the crank arm moving each sliding element. By positioning the sliding element 42 controlling the second support element 27 of the differential feed dog 17 in a different manner from the sliding element 42 controlling the first support element 26 of the main feed dog 16, it is possible to obtain a different feed action for the two feed dogs. The alternating feed movement resulting therefrom is perfectly symmetrical with respect to the needle plate since both the support elements 26 and 27 are raised by the same amount by said lifting kinematic mechanisms and at the same time are moved in synchronism by the same element, that is to say the stirrup 38. By positioning the sliding part 42 which adjusts the second support element 27 of the differential teeth 17 in a different manner from the sliding element 42 which adjusts the first support element 26 of the main teeth 16, it is possible to obtain a different feed action for the two sets of teeth.

The alternating feed movement resulting therefrom is perfectly symmetrical with respect to the needle plate since both the support elements 26 and 27 are raised by the same amount by the said lifting mechanisms and at the same time are moved in synchronism by the same element, that is to say the stirrup 38.

The invention thus achieves the proposed objects.

Particular attention is drawn to the simplicity of the structure achieved, its small dimensions, the small number of parts from which it is formed and, in particular, the ease with which the travel of the main teeth 16 and of the differential teeth 17 can be adjusted, as well as to the possibility of varying the actual travel by significant amounts.

All the details can be replaced by technically equivalent features.

In practice, the materials used, the shapes and dimensions may be of any nature or magnitude, as required.

We claim:

1. A device for feeding fabric being sewn by a sewing machine comprising:

a. a rotatable main shaft;

b. a secondary shaft mounted adjacent said main shaft having its axis extending parallel to thereto, said secondary shaft being made of first and second half-shaft sections aligned and freely rotatable with respect to each other which are rotatably joined;

c. a stitch adjustment eccentric mechanism mounted on said main shaft and operably connected to said first section of said secondary shaft to effect oscillation thereof;

d. means connecting the said second section of said secondary shaft to said main shaft to effect continuous rotation thereof;

e. support means including sets of main and secondary feed dog teeth supported by block mounted cams, one of said two block mounted cams being mounted on said main shaft and the other of said block mounted cams being mounted on said secondary shaft;

f. a generally U-shaped stirrup having a first sleeve on one end secured to said first section of said secondary shaft; and having a second sleeve freely mounted on said second section of said secondary shaft and g. sliding elements mounted on the arms of said U-shaped stirrup; said device causing said feed dog teeth to move cyclically up and down and forward and backward in a synchronized manner to a tensioned fabric on a needle plate.

2. The feed device as claimed in claim 1, wherein the said support elements are slidably fixed to the said blocks surrounding the said cams, and wherein the same support elements engage with the said blocks via mutually opposite forks pointing in opposite directions.

3. The feed device as claimed in claim 1, wherein the said first half-shaft is oscillatable cyclically under the action of the said main shaft, and wherein the said first half-shaft is connected to the said main shaft by the stitch-adjustment eccentric operating a connecting rod and an arm, the end of the latter being integral with the said first half-shaft.

4. The feed device as claimed in claim 1, wherein the said second half-shaft section is operated upon rotation of the said main shaft via a toothed belt and associated pulleys arranged at the free ends of the said main shaft and said second half-shaft.

5. The feed device as claimed in claim 1, wherein the said first half-shaft section fits inside the said second half-shaft in telescopic fashion in a middle section of the said secondary shaft.

6. The feed device as claimed in claim 1, wherein the said stirrup is shaped substantially in the form of an inverted U and has arms the ends of which are integral with the said first and second sleeves, the said arms being located alongside the said support elements on opposite sides.

7. The feed device as claimed in claim 6, wherein the said arms have slots which are substantially vertical and designed to be arranged adjacent to grooves which are also substantially vertical and are provided in the said support elements, and wherein said slidable elements can be inserted in the said grooves and can be fixed in a predetermined position in the said slots.

8. The feed device as claimed in claim 1, wherein the said support elements are connected to the said teeth via joining elements which can be positioned with respect to the said support elements.

* * * * *